US012208320B2

(12) United States Patent
Bown

(10) Patent No.: US 12,208,320 B2
(45) Date of Patent: Jan. 28, 2025

(54) AUTOMATED GOLF BALL TEEING DEVICE

(71) Applicant: James T. Bown, Asheboro, NC (US)

(72) Inventor: James T. Bown, Asheboro, NC (US)

( * ) Notice: Subject to any disclaimer, the term of this patent is extended or adjusted under 35 U.S.C. 154(b) by 0 days.

(21) Appl. No.: 18/593,889

(22) Filed: Mar. 2, 2024

(65) Prior Publication Data

US 2024/0293710 A1 Sep. 5, 2024

Related U.S. Application Data

(60) Provisional application No. 63/488,309, filed on Mar. 3, 2023.

(51) Int. Cl.
*A63B 57/00* (2015.01)

(52) U.S. Cl.
CPC ..... *A63B 57/00* (2013.01)

(58) Field of Classification Search
CPC ..... A63B 57/0037; A63B 57/00
See application file for complete search history.

(56) References Cited

U.S. PATENT DOCUMENTS 2,828,525 A * 4/1958 Gail ..... F16L 33/04 24/279
3,904,200 A * 9/1975 Jackle ..... A63B 57/0037 473/133
5,205,598 A * 4/1993 Miller ..... A63B 57/0037 294/19.2
5,306,000 A * 4/1994 Comella ..... A63B 57/10 15/21.2
5,439,213 A * 8/1995 Pimentel ..... A63B 57/0037 473/386
5,499,813 A * 3/1996 Black ..... A63B 57/0037 473/386
5,669,646 A * 9/1997 Fiocca ..... A63B 57/203 294/19.2
5,672,121 A * 9/1997 Miller ..... A63B 57/0037 294/19.2
6,254,497 B1 * 7/2001 Brant ..... A63B 47/02 473/406
6,338,685 B1 * 1/2002 Posluszny ..... A63B 57/0037 473/386
6,394,515 B1 * 5/2002 Keleher ..... A63B 47/02 294/19.2
6,843,737 B1 * 1/2005 Smith ..... A63B 57/0037 473/386
7,175,547 B2 * 2/2007 Naus, Jr. ..... A63B 57/0006 473/386
D656,569 S * 3/2012 Cisneros ..... D21/720
8,529,379 B1 * 9/2013 Faircloth ..... A63B 55/10 294/19.2

(Continued)

FOREIGN PATENT DOCUMENTS

WO WO-2012062974 A1 * 5/2012 ..... A63B 57/0006

*Primary Examiner* — Steven B Wong
(74) *Attorney, Agent, or Firm* — Sam Pierce

(57) ABSTRACT

The present invention provides a multifaceted device for installing and removing golf balls, tees and ball markers designed to vary for a golfer's desired ball height. The invention incorporates an electromagnet solenoid which can be turned on and off to retain and release a ball marker. The device is designed to eliminate the otherwise necessity of stooping and bending when engaging in the sport of golf.

8 Claims, 3 Drawing Sheets

(56) References Cited

U.S. PATENT DOCUMENTS

| | | | | |
|---|---|---|---|---|
| 8,870,686 | B1 * | 10/2014 | Johnson | A63B 57/0037 473/386 |
| 9,182,063 | B2 * | 11/2015 | Rigollet | F16L 23/08 |
| 11,400,353 | B1 * | 8/2022 | Mecham | A63B 57/0037 |
| 2002/0022539 | A1 * | 2/2002 | Smith | A63B 47/00 473/405 |
| 2003/0203772 | A1 * | 10/2003 | Paine | A63B 57/0037 473/386 |
| 2004/0029653 | A1 * | 2/2004 | Whitehill | A63B 57/0037 473/386 |
| 2010/0125007 | A1 * | 5/2010 | Green | A63B 57/353 473/386 |
| 2019/0046850 | A1 * | 2/2019 | Stacy | A63B 1/00 |
| 2023/0302336 | A1 * | 9/2023 | Blain | A63B 71/023 |

* cited by examiner

AUTOMATED GOLF BALL TEEING DEVICE

BACKGROUND

The prior art patent literature recognizes that some golf players develop orthopedic problems making it difficult to bend over to implant a golf tee in the turf and then place a golf ball thereon.

For example, U.S. Pat. No. 5,540,432 discloses a device with an elongated tubular member having open upper and lower longitudinal ends, in which is placed an elongated solid rod (either circular or rectilinear in cross section) slidably mounted therein, with both of the longitudinal ends of the rod projecting somewhat from the ends of the tubular member. A hand grippable member is attached fixedly at the upper end of the tubular member so that one longitudinal end thereof which overlaps and encloses the projecting upper end of the rod member. A cantilever member is aligned axially within of the one lower longitudinal ends of the hand grippable member. It has a finger-engageable element along the distal surface of that longitudinal end; and the grippable member has at its other longitudinal end, an underside planar surface normally contacting the upper rod end; a spring means is located proximal to the intermediate the segment of the cantilever member, and serves to bias same to hold a non-displacing contact with the upper rod end. The upper rod end itself has mounted thereon a second spring member, which is adapted to bias the elongate rod to move in a direction upwardly within the hand grippable member. The juxtaposition of the contacting cantilever member and of the upper rod member end are such that the rod will move reciprocally downward within the tubular member, if the finger engageable element is activated to move in its arcuate path of motion; a first flange-like element is affixed at one point on the lower section of the tubular member periphery and is adapted to rest a golf ball thereon via gravity, until the ball is physically dislodged. A second flange-like member is affixed at an opposing point on the lowermost periphery of the tubular member, and provides the function of limiting the degree of shift of the elongate rod end upwardly under the bias of the second spring means. Lastly, a third flange-like element is located beneath and adjacent to the second flange element and is pinned to the lowermost rod end, also being provided with an inwardly oriented recess, sized to support the shank of a golf tee; the adjacent second and third flange elements are normally biased by the spring-loaded rod member in a releasable clamping juxtaposition, that can be opened by the digital activation of the finger engageable element. It is then is maintained spaced-apart by such digital bias, or by the insertion of the tee in the resting recess provided in the third flange mean.

U.S. Pat. No. 4,466,650 discloses a combination tool for handling a golf ball and a golf tee, comprising: an elongated hollow member; actuating rod means disposed in said hollow member for longitudinal movement thereto; a first head mounted on a first end of the hollow member, and a second head mounted on the opposite end thereof; the first head having an opening for receiving a tee in a position supported in the path of motion of the actuating rod means; retainer means mounted in the first head for engaging the tee to releasably retain it in position, the tee being supported so as to be removed from the first head in response to a motion of the actuating rod means with respect to the elongated hollow member; a plurality of jaw members mounted on the second head adjacent the actuating rod; a guide member connected to the actuating rod and engaged with the jaw members to move them toward either a first spaced position for receiving a golf ball between them, or a second, closed position in which they engage the ball between them; and bias means urging the jaws towards said closed position.

However, prior art devices typically do not allow for multiple functions and are difficult to use particularly for persons with orthopedic infirmities.

SUMMARY OF INVENTION

Therefore, the present invention provides a multifaceted device for installing and removing golf balls, tees and ball markers designed to vary for a golfer's desired ball height. The invention incorporates an electromagnet solenoid for retrieving and releasing a ball mark.

The device is designed to eliminate the otherwise necessity of stooping and bending when engaging in the sport of golf. With this invention's ability to place the tee and the ball, retrieve both the ball and tee and by placing and retrieving the ball mark, and by retrieving the ball from the putting surface and cup, this tool eliminates all causes a golfer has for stooping, kneeling or bending over adding pleasure and longevity to the player's golf experience.

DETAILED DESCRIPTION

This invention is intended to allow the user to enjoy an entire round of golf without ever needed to stoop, bend over or kneel. People with bad knees, backs and of an older age along with a host of other ailments have a hard time playing the game of golf because of all the times it is necessary to bend, stoop or kneel.

The present invention is easy to use for teeing up a golf ball because of the stabilizing ring with pins that make it so user friendly that a player can place a tee and ball with closed eyes. This tool also is useful the other circumstances when bending was required, like picking up the tee after teeing off, marking the ball on the green, picking up golf clubs, and picking up and replacing ball after marked and even the marker itself is not an issue with the electromagnet switch incorporated in this design.

Improvements on Pre-Existing Inventions

There has been no all in one tool on the market to remove the need to stoop and bend over in the game of golf before this invention. There have been tools designed to place the ball and tee but it is quite difficult to not knock the ball off the tee when removing their tool. These others have had problems breaking after one use. None of these others have accounted for placing or retrieving the ball mark or retrieving the ball from the cup.

Other Uses or Applications for This Invention

This tool can place and remove a ball mark using the unique and original electromagnet system incorporated into this design. Using the switch that turns the magnet on and off makes it so the player will not need to bend over while on the course at any point during the round.

Figure 1:
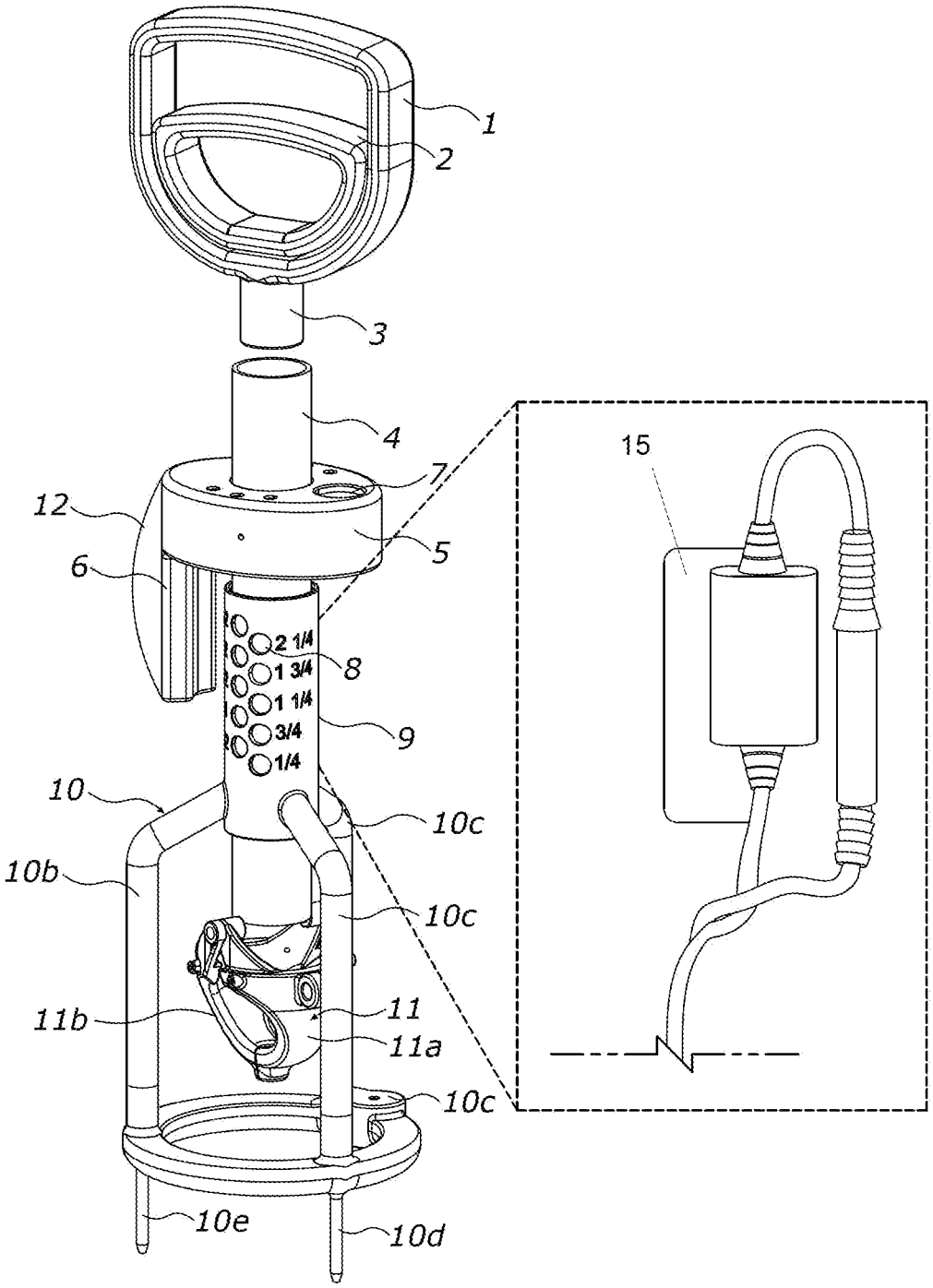
FIG. 1 illustrates the device according to the present invention.

FIG. 1 illustrates the device according to the present invention.

This invention uses a simple straight forward design. It uses two handles, one small operational handle 2—lower handle (actuated by pulling up) inside of a larger fixed handle 1—upper handle (stationary) to operate the ball and tee holder by simply squeezing the two handles together with one hand. A wire connected to the lower handle 2 runs to first jaw 11*a* and second jaw 11*b* and by actuating lower handle 2 the wire pulls first jaw 11*a* and second jaw 11*b* up and apart.

To use the device, the ball is placed inside 11—ball holder while the handle is pulled to open 11*a*—first jaw and 11*b*—second jaw. The jaws are spring loaded and open up a little bit to trap a tee. The ball and tee are secured and the player can handle the tool with no concerns of the ball or tee falling from the tool.

Then player can find a preferred location and can either drop the tool from its handle about a foot above the ground or use the affixed handle to push the tool until the stabilizing 10*d*—pin for insertion into the ground and 10*e*—additional pin for insertion into the ground are against the ground. Now the player simply pulls the handles together and lifts the tool up. The ring and pins make removing the tool easy while other products are much more difficult to use. The player can also pick up the tee by raising the stabilizing ring and using the handles to open the jaws and release to capture the tee.

When the green is reached the player turns on the electromagnet 15 with the conveniently located switch, put a ball mark against the magnet and place the magnet right behind the player's ball. The player can then switch the magnet back off and the ball mark stays into place. Electromagnet 15 can be controlled wirelessly via a wireless controller or a switch can be provided on the device wired to the battery associated with the solenoid for electromagnet.

Then the player can use the tool to pick the ball up and wait for the player's turn to putt. Then the player can place the ball in front of the ball mark, turn the magnet on and use it to pick up the ball mark and the player is ready to put. Once in the cup the player simply places the tool over the hole, squeezes the handles together to separate first jaw 11*a* and second jaw 11*b*, sets the tool on top of the ball and release the handles and the ball is captured in the ball and tee holder, i.e., ball holder 11. That is the sequence for using this invention to play golf without bending down.

The device can be hung on a golf bag by 6—attachment to hold the device on the outside of a golf bag and 12—brace can be used to hold. 5—caddy for tees and ball markers can also hold a remote to wirelessly control the electromagnet. Slot 7 is space for a ball marker.

Ball height adjustment 8 allows for the user to put a selection which adjusts how close the jaws are to the ring from which the pins extend. If the jaws are further from the ring when the ring hits the ground, the ball will be teed up higher.

The following reference numerals are illustrated in the drawing of the device in FIG. 1.

1—upper handle
2—lower handle
3—locking part of the upper handle containing a screw connected to a piece of square tubing (aluminum) 4 inches long, ⅜ of an inch square. It protrudes so when the wire lifts up it doesn't get to the handle.
4—tube locking containing wire rope of stainless teel.
5—caddy for tees and ball markers and can hold a remote.
6—attachment to hold the device on the outside of a golf bag.
7—space for a ball marker. There is a magnet for the ball marker to hold it in place.
8—ball height adjustment
9—tube.
10—ring support member
10*b*—ring support member
10*c*—ring support member connecting to electromagnet. The electromagnet holds the ball marker below 10*c* when the electromagnet is engaged and drops the electromagnet from 10*c* when the electromagnet is turned off.
10*d*—spike for inserting into the ground to stabilize device while ball is being teed and enable the tee to stand on its own.
10*e*—additional spike for inserting into the ground to stabilize device while ball is being teed.
11—ball holder
11*a*—first jaw
11*b*—second jaw
12—brace
15—solenoid and battery controlling electromagnet.

Figure 2:
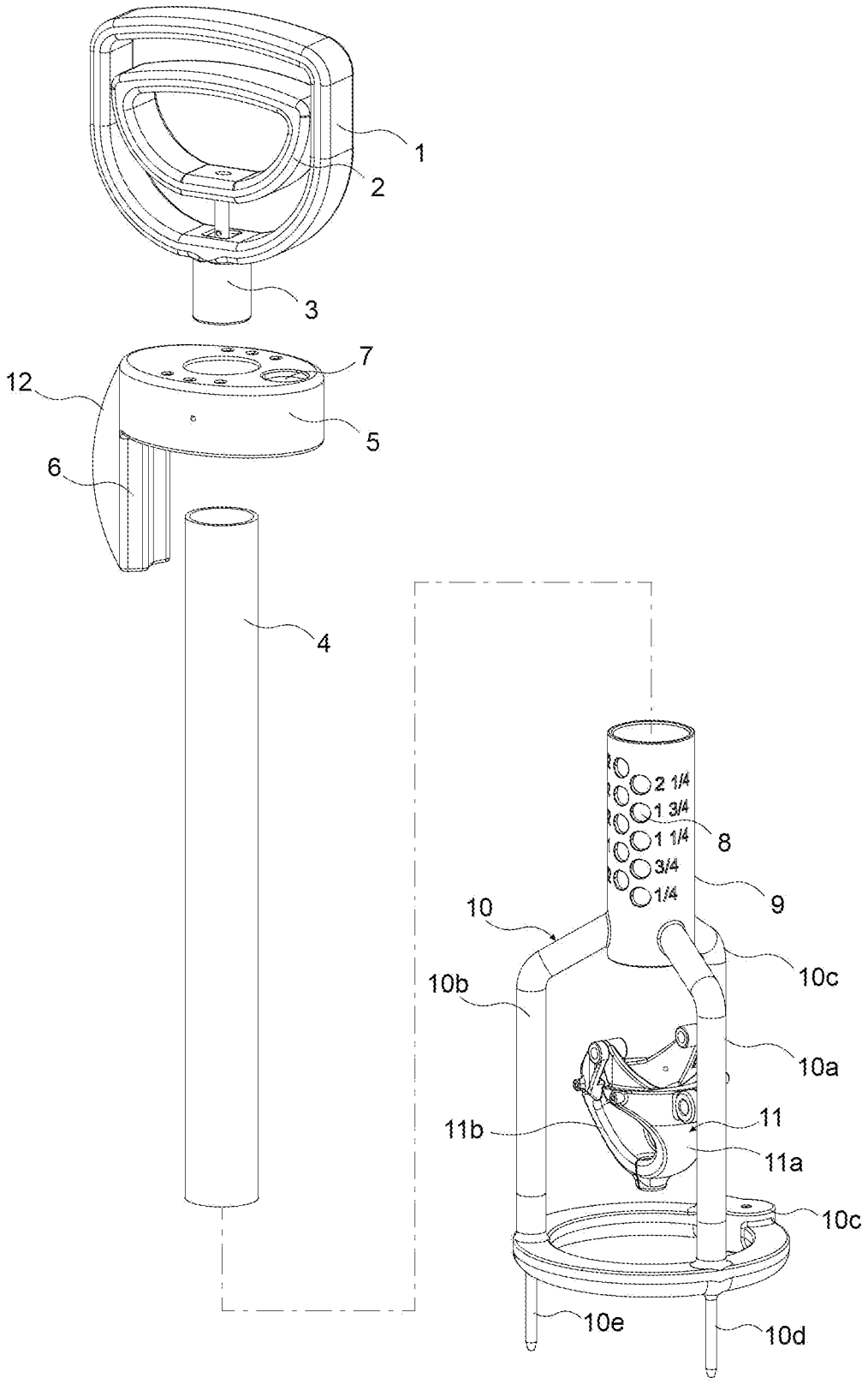
FIG. 2 illustrates an exploded view of the device according to the present invention.

FIG. 2 illustrates an exploded view of the device according to the present invention.

Figure 3:
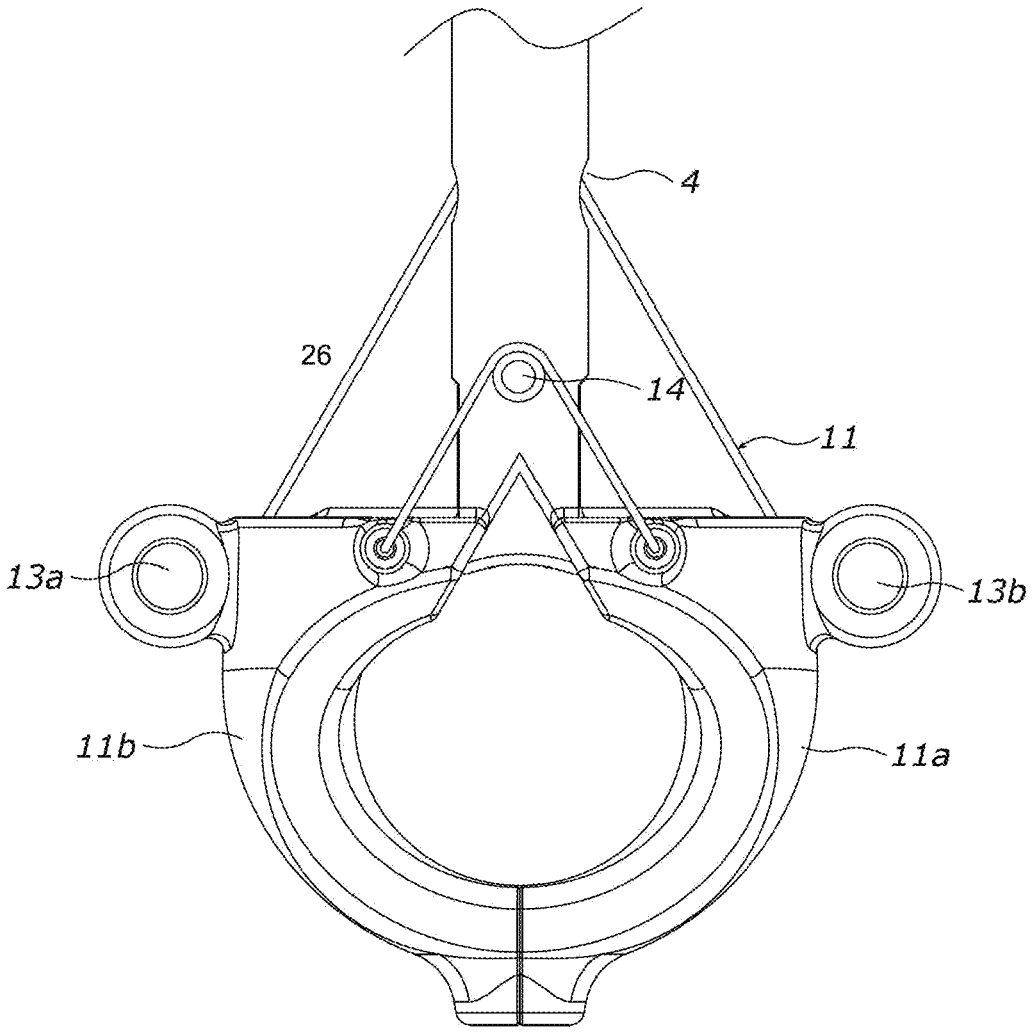
FIG. 3 illustrates the ball and tee holder in the device according to the present invention.

The following reference numerals are illustrated in FIG. 2:

1—upper handle
2—lower handle
3—locking part of the upper handle which locks the handle to the tube
4—tube locking part
5—spare tees
6—bag handle
7—electromagnetic handle
8—ball height adjustment
9—tube
10—ring support member
10*a*—ring support member
10*b*—ring support member
10*c*—magnet positioned on the ring
10*d*—pin/spike for inserting into the ground for stability
10*e*—pin/spike for inserting into the ground for stability
11—ball holder
11*a*—first jaw
11*b*—second jaw
12—brace FIG. 3 illustrates the ball and tee holder in the device according to the present invention.

The following reference numerals are illustrated in FIG. 3:

4—tube. The wire rope 26 comes out of the tube to attach to the jaws.
11—connection piece from tube to ball holder. 11 loops around 13*a* and 13*b* and then connects back to itself 11 with a bolt in the hole to connect the wire to the ball holder.
11*a*—first jaw for ball holder
11*b*—second jaw for ball holder
13*a*—first insert for wire rope.
13*b*—second insert for wire rope.
14—bolt that goes through jaws on both sides and goes through the tube. Springs extend from the bolt to first jaw 11*a* and second jaw 11*b* for holding the jaws in place and providing resistance to opening.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description.

Other embodiments may be utilized and derived from the present invention, such that structural and logical substitutions and changes may be made without departing from the scope of this disclosure.

Figures are also merely representational and may not be drawn to scale. Certain proportions thereof may be exaggerated, while others may be minimized. Accordingly, the specification and drawings are to be regarded in an illustrative rather than a restrictive sense. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments.

Combinations of the above embodiments, and other embodiments not specifically described herein, will be apparent to those of skill in the art upon reviewing the above description. Therefore, it is intended that the disclosure not be limited to the particular embodiment(s) disclosed.

What is claimed is:

1. A device for retrieving and placing golf items, comprising:

a fixed handle;

an actuatable handle;

a first end of a wire rope attached to the actuatable handle;

a tube containing the wire rope;

first and second jaws attached to a second end of the wire rope;

a ring surrounding the first and second jaws;

one or more spikes for insertion into the ground extending from the ring and a magnet positioned on the ring on the same said of the ring where the spikes extend, wherein the magnet is an electromagnet controlled by a solenoid with a battery.

2. The device for retrieving and placing golf items of claim 1, further comprising a switch for turning the electromagnet on and off.

3. The device for retrieving and placing golf items of claim 2, wherein the electromagnetic switch is connected wirelessly to the electromagnet.

4. The device for retrieving and placing golf items of claim 2, wherein the electromagnetic switch is connected to the electromagnet by a wire.

5. The device for retrieving and placing golf items of claim 1, further comprising two or more ball height adjustment pin holes.

6. The device for retrieving and placing golf items of claim 5, wherein the pin holes locks the height of the ring relative to the height of the first and second jaws.

7. The device for retrieving and placing golf items of claim 1, further comprising an attachment configured to hang the device on a golf bag.

8. The device for retrieving and placing golf items of claim 1, further comprising a caddy for one or more of tees, balls, and ball markers.

* * * * *